US005542729A

United States Patent [19]

Ohtonen

[11] Patent Number: 5,542,729

[45] Date of Patent: Aug. 6, 1996

[54] TWO SIDED CLAMP FOR MANIPULATING HEADS OF PAPER ROLLS

[75] Inventor: Aimo Ohtonen, Kerava, Finland

[73] Assignee: Valmet Corporation, Helsinki, Finland

[21] Appl. No.: 182,715

[22] Filed: Jan. 14, 1994

[30] Foreign Application Priority Data

Feb. 9, 1993 [FI] Finland ..... 930546

[51] Int. Cl.[6] ..... B25J 15/06; B65G 47/91

[52] U.S. Cl. ..... 294/87.1; 294/65; 414/736; 414/737; 414/797; 901/40

[58] Field of Search ..... 294/64.1, 65, 86.4, 294/87.1, 81.6; 53/211; 271/90, 91, 103; 414/627, 736, 737, 797; 901/40

[56] References Cited

U.S. PATENT DOCUMENTS

| | | | |
|---|---|---|---|
| 3,166,202 | 1/1965 | Arnold | 414/627 |
| 3,285,433 | 11/1966 | Beneke et al. | 414/627 |
| 3,908,812 | 9/1975 | Graff | 294/65 X |
| 4,571,320 | 2/1986 | Walker | 294/65 X |
| 4,775,271 | 10/1988 | Maccaferri | 414/736 X |
| 4,840,008 | 6/1989 | Hood et al. | 294/65 X |
| 4,884,938 | 12/1989 | Fujita et al. | 901/40 X |
| 5,336,029 | 8/1994 | Kato et al. | 414/627 X |

*Primary Examiner*—Johnny D. Cherry
*Attorney, Agent, or Firm*—Cohen, Pontani, Lieberman, Pavane

[57] ABSTRACT

A two-sided clamp for manipulating heads of paper rolls, which includes an arm having one end attached to the wrist joint of a robot and another end that carries two grasping members which are aligned parallel and outwardly facing in opposite directions. Each of the grasping members has a base plate and multiple resilient suction cups which are mounted to the base plate. The grasping members are mounted to the arm so that the clamping center point of the first grasping member is farther removed from the wrist joint of the robot in the direction of the longitudinal axis of the arm than the clamping center point of the second grasping member. The grasping members are mounted in an asymmetrical manner to the arm, which asymmetrical structure of the clamp facilitates the two-sided structure of the clamp.

4 Claims, 2 Drawing Sheets

FIG. 2
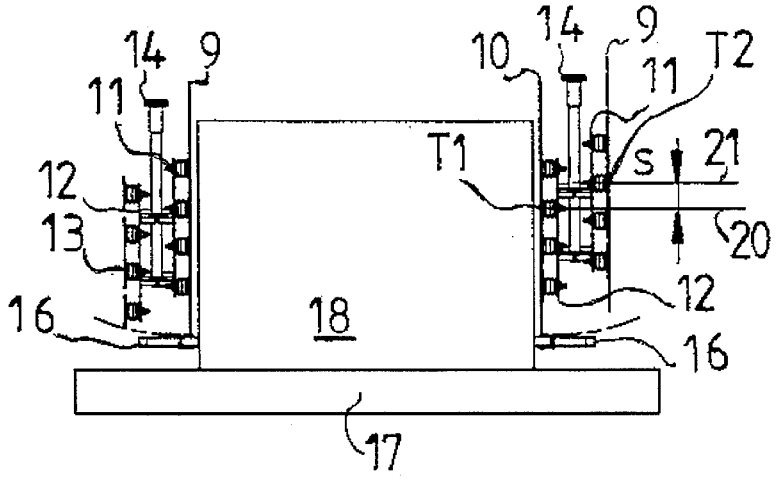
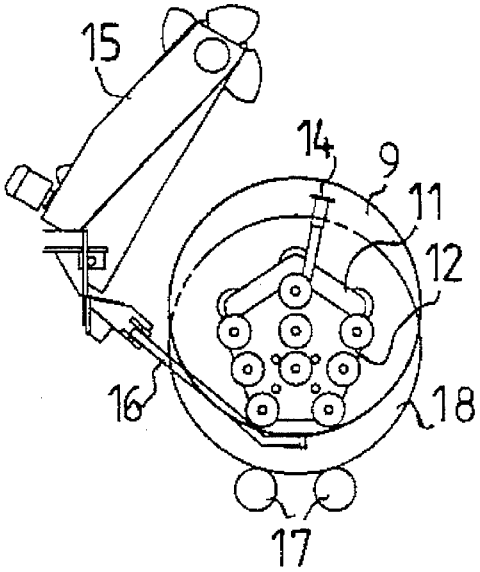
FIG. 4
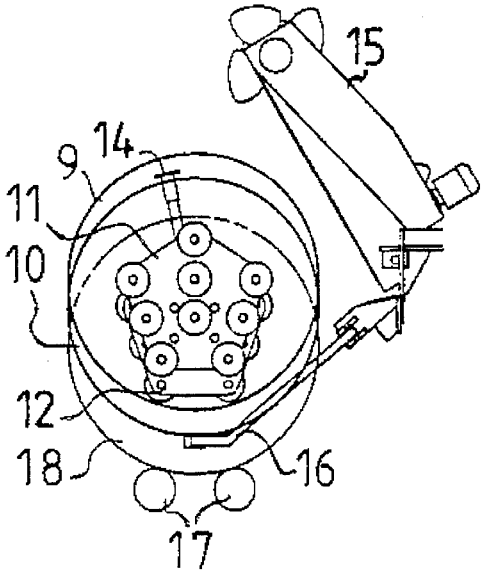
FIG. 3

TWO SIDED CLAMP FOR MANIPULATING HEADS OF PAPER ROLLS

BACKGROUND OF THE INVENTION

1. Field of the Invention

The present invention relates to a two-sided clamp for placing heads on the ends of paper rolls.

2. Description of the Prior Art

In the wrapping of paper rolls the inner heads are first placed onto the ends of each roll, after which a sufficient length of the wrapper is placed about the roll and then the overlaps of the wrapper are crimped over the rims of the inner heads. Conventionally, using a hot-melt glue, the outer heads are then adhered to the ends of the roll, thus covering the crimped edge of the wrapper and the inner head. The inner head is usually relatively thick and thus capable of protecting the roll end against mechanical damage. The outer head can thus be thinner serving the purpose of binding the wrapper at the roll ends and protecting the roll against humidity. Frequently, the coloring and printed pattern of the outer head are designed to give the roll a neat appearance.

The heads can be placed on the roll ends in a number of different ways. Manual placement of the heads is the oldest method, and it is still suitable for relatively small-capacity wrapping lines or applications not requiring an improved degree of automation. Here, the operator simply places the inner heads manually to the roll ends and the corresponding outer heads onto heated press platens, which next press the outer heads to adhere to the roll ends. The inner heads are held against the roll ends by means of separate retaining arms for the duration of the crimping of the wrapper overlaps against the roll ends. The adherence of the outer heads on the platens is in turn implemented with the help of a vacuum.

Various kinds of automatic heading machines have long been in use and several different types of such equipment are-known. A common feature for almost all automatic heading equipment is that, for each end of the roll, a separate apparatus with a head clamp is provided that serves for moving the head from the head pile to the roll end. In a prior-an heading machine, a rotatable arm is mounted on a vertical guide, and has at its end a rotatable vacuum clamp for grasping the heads. Such a heading machine is conventionally used in conjunction with different kinds of head storage shelves situated beside the heading machine. Using this machine, the heads are placed on the roll end so that the support arm of the clamp is transferred along the vertical guide to the level of the shelf containing the correct head size. Next, the support arm of the clamp and the heading machine itself are rotated until the machine is aligned parallel with the shelf. Subsequently the head is picked and transferred from the shelf to the roll end by rotating both the arm and the heading machine and moving the heading machine along the guide.

In another system, the heads are placed stacks or in piles on the factory hall floor and are transferred to the roll ends by means of gantry heading manipulators. The gantry transfer carnage is constructed above the head piles, and the heading manipulators are generally placed on a single, crosswise movable rail. Thus, a separate pile of heads of a predetermined size must be provided for each heading manipulator.

A major drawback of the above-described systems is in that a separate heading machine plus a dedicated head storage shelf or head pile is required for both of the roll ends.

The heading machines employed are specifically built for manipulating heads only, whereby their control software is tailored particularly for each operating environment. Therefore, modifications to the operation of the system are cumbersome and require specialized design capabilities.

To overcome these impediments, a standard industrial multi-axis robot can be employed for placing the heads. Such a robot can be integrated with the layout of the wrapping line in a manner permitting the robot to place a head on both ends of the roll. For effective use of the robot, it must be provided with a two-sided clamp which through a flipping movement of the clamp is capable of sequentially picking heads for both roll ends, whereby the need for two separate head-fetching cycles is obviated. However, a conventional two-sided clamp is generally unsuitable for placing the inner heads. Namely, when the inner head is placed against the roll end, a retaining arm is first rotated against the inner head to hold it against the roll end. Now, if a two-sided clamp would be used in which both of the fetched heads are aligned to the same axis of the clamp, the head-retaining arm would first hit the head on the side outward from the roll end causing damage to the head or its detachment from the vacuum clamp. Moreover, the retaining arm could not rotate against the head placed at the roll end, whereby the already placed head would resultingly detach from the roll end.

For the above-described reasons, the clamp must be provided with a mechanism capable of transferring at least one of the suction head members of the clamp so that the suction head members are displaced asymmetrically thus permitting the head-retaining arm to freely rotate against the head already placed at the roll end. Such a mechanism can be implemented by means of a guide rail and a transfer motor, or alternatively, different types of lever mechanisms.

Obviously, the implementation of such a transfer mechanism in a clamp is a most demanding task. The clamp of the robot arm should offer maximum operational reliability and light weight, because the mass of the clamp directly affects the available payload capacity, operating speed and accuracy of the system. The additional mechanisms contribute to the mass of the clamp and require separate wiring for power feed and control. The routing of conductors to the clamp of the robot arm is obviously a difficult task. Thus, the implementation of a relatively simple transfer mechanism in a clamp may lead to significant technical problems. It must be further noted that the transfer mechanism brings about an additional axis to the system which complicates the adaptation of the robot software to the operating environment and adds to the programming work.

SUMMARY OF THE INVENTION

It is an object of the present invention to achieve a simple two-sided clamp for manipulating the inner heads of paper rolls.

The invention is based on placing the suction members of the clamp in such a fixed and asymmetrical manner to the clamp that the central axes of heads picked by the clamp are displaced a distance from each other.

More specifically, the clamp according to the present invention has an asymmetrical construction wherein the normals passing through the clamping center points of the two grasping means are displaced from each other.

The present invention offers significant benefits.

The use of a two-sided clamp is a necessity if it desired to place roll heads using only a single robot. With the use of a single-sided clamp, the cycle time of heading would become excessively long, thus defeating investment in an expensive industrial robot. A mandatory prerequisite on high-speed wrapping lines is a short cycle time of heading which can be attained only through minimizing the number of movements performed by the head manipulating robot. The present invention makes it possible to implement a two-sided clamp in an extremely simple and cost-effective manner. Both suction members of the clamp can be identical and mounted to the clamp by means of fixtures acting resiliently in a fault situation, thus preventing damage to the clamp and permitting easy and rapid repair of the fixtures. Also, the clamp does not require any transfer mechanisms. Consequently, the fabrication of the clamp can be implemented with a minimum number of pans, and it offers maximum operational reliability, light weight and simple construction.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the drawings, wherein like reference numerals delineate similar elements throughout the several views:

FIG. 2 shows the heading as seen from the side of the roll being wrapped,

FIG. 3 shows the placing of the first head as seen from the end of the roll being wrapped; and FIG. 4 shows the placing of the second head as seen from the end of the roll being wrapped.

DETAILED DESCRIPTION OF THE PREFERRED EMBODIMENTS

Figure 1:
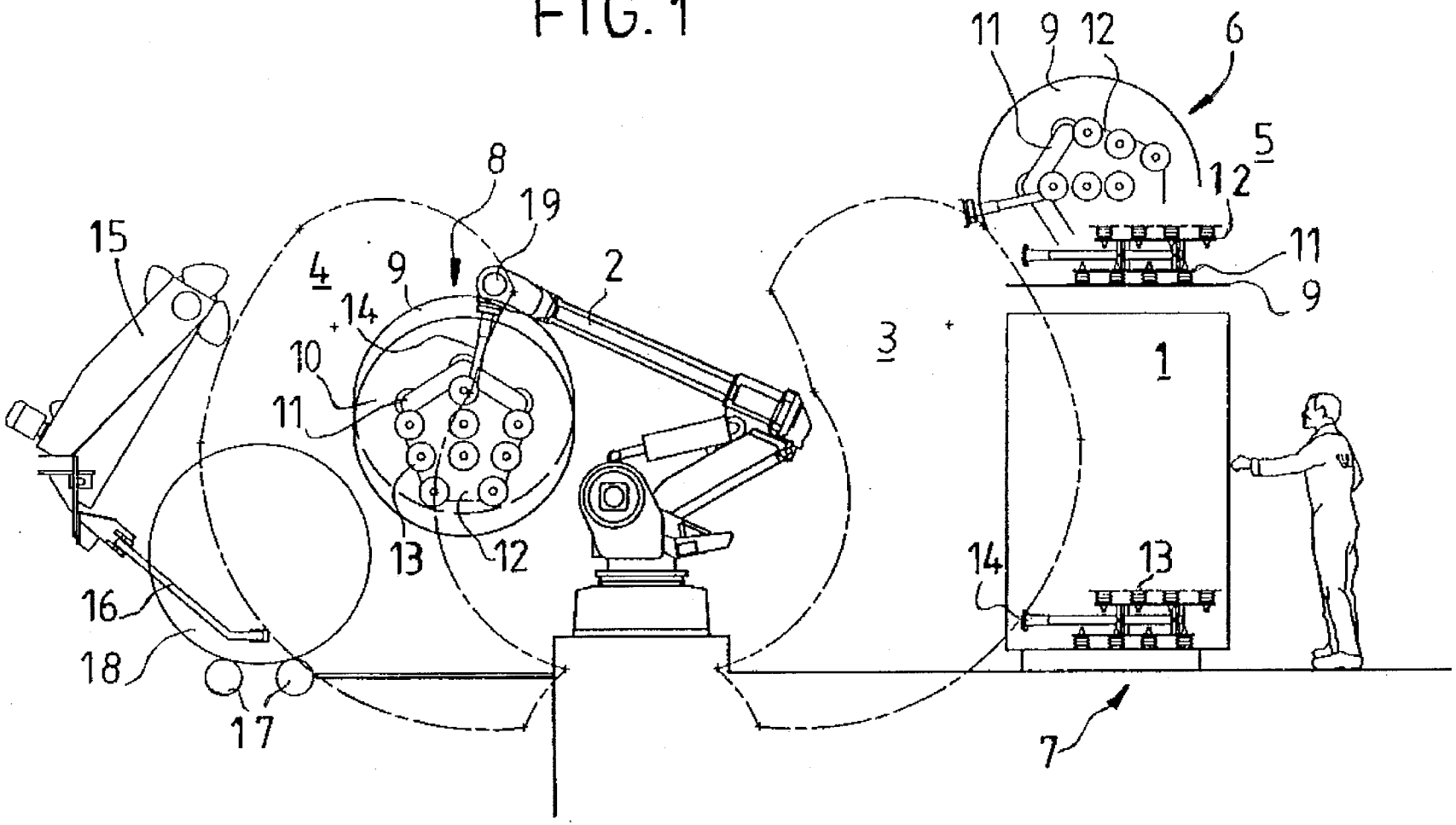
FIG. 1 shows heading with the help of a robot using a clamp according to the present invention.

In the detailed description of the present invention given below, the term "first head" denotes the head which is placed first on one end of the roll. The heads are indicated by dashed lines in the diagrams to attain greater clarity of the clamp construction.

With reference to FIG. 1, a pile or stack of heads 1 is shown to the right and a roll 18 to be wrapped is seen to the left placed on support rollers 17, together with a crimping apparatus 15 for the wrapper overlaps and a retaining arm 16 of the head. Between these is situated an industrial robot 2 that transfers heads to the ends of the roll 18 being wrapped. The working envelope of the robot 2 is depicted as an area 3 delineated by dashed lines on the side of the head pile 1. This area is called the fetching area. Correspondingly, the area 4 covered by the movement envelope of the robot 2 on the side of the roll 18 is called the delivery area. The border line delineated by the envelope of the movement areas 3 and 4 is determined by the movement envelope of the robot's most distal wrist joint 19. The clamp is attached to this wrist joint 19. The clamp comprises an arm member 14 having its one end attached to the wrist joint 19 of the robot and its other end carrying two suction members 11, 12 having their planes aligned parallel and outwardly facing in opposite directions. Referring also to FIG. 2, both suction members 11, 12 comprise a base plate and a number of resilient suction cups 13 flexibly attached to the base plate. A clamping center point T2, T1 can be determined for each suction members 11, 12, respectively to the point at which the center axis 21, 20, respectively of a correctly clamped head 9, 10, respectively, should be aligned. The suction members 11, 12 are attached to the arm member 14 so that the clamping center point T1 of the first suction member 12 is farther removed from the wrist joint 19 of the robot 2 in the direction of the longitudinal axis of the arm member 14 than the clamping center point T2 of the second suction member 11. The suction members 11, 12 are mounted asymmetrically in the above-described manner to the arm member 14 with an asymmetry displacement s.

The benefits of the asymmetrical mounting will be evident from the subsequent description of the operation of the robot heading system. The operating sequence is started by picking a head from the head pile 1. This position of the robot is indicated by reference numeral 5 in that part of FIG. 1 where a head 9 is being picked from a full head pile 1. Reference numeral 7 indicates that robot position which corresponds to picking a head from an almost depleted pile. In the case shown in FIG. 1, the clamp has first been used for picking the second head 9, that is, the head to be placed as the latter one to the ends of the roll 18. The second head 9 is always picked by the second suction member 11, whose clamping center point T2 is closer to the wrist joint 19 of the robot. Next, the clamp is slightly elevated and rotated 180° about the longitudinal axis of the arm member 14. The position of the clamp in the middle of the rotation is indicated by reference numeral 6 in the related part of FIG. 1. After the rotation movement is completed, the first head 10 is picked by the first suction member 12.

Next, the clamp with the picked heads 9, 10 is manipulated to move beside the roll 18 being wrapped, and the heads are placed on the roll ends. Reference numeral 8 in FIG. 1 indicates the position of the clamp and the robot 2 prior to the placing of the heads 9, 10 to the ends of the roll 18. The placing step of the heads 9, 10 to the roll ends is shown in FIGS. 2–4.

With reference to FIG. 2, the roll 18 is shown resting on the support rollers 17 as viewed from the side of the robot 2 in the same manner as in FIG. 1. Accordingly, the first head 10 is placed on the right end of the roll, and the second head 9 is then placed on the left end of the roll. Though the placing of both heads is shown in a single diagram, in practice they are placed through sequential steps.

During the placing of the first head 10, the clamp is controlled to the position shown on the right side of FIG. 2. Here the first suction member 12 with the head 10 adhering to it is facing the end of the roll 18 so as to align the head parallel with the end of the roll 18. In the vertical direction the head 10 is not precisely centered with the end of the roll 18, but rather, slightly above. In this position the head 10 is released from the suction member 12 allowing the head to drop onto the support rollers 17, after which the retaining arm 16 is rotated in the manner indicated in FIG. 2 against the head 10 to abuttingly retain the head 10 against the roll end for the duration of wrapper crimping. As soon as the retaining arm 16 has been rotated against the head 10, the clamp can be to manipulated to move off the end of the roll 18 and transferred to the opposite end of the roll, where the second suction member 11 with the second head 9 is manipulated to move to an identical position relative to the roll end as described above for the first head. At this end, the first suction member 12 assumes a position which is lower than that of the suction member 11 facing the end of the roll 18, but as the head 10 is no longer adhered to the suction member, the retaining arm 16 can be freely rotated against the second head 9 after the head is correspondingly dropped onto the support rollers 17.

FIG. 3 illustrates the placing of the first head 10 as seen from the end of the roll, and respectively, FIG. 4 illustrates the placing of the second head 9.

As is evident from the above description, the heads 9, 10 are not aligned entirely centrally with the end of the roll 18, but rather, are dropped onto the support rollers 17. This is because the mutual displacement s of the suction members cannot be increased to such a large distance which for all sizes of heads would permit the retaining arm for the first head 10 to be rotated past the edge of a second head 9 being held by the clamp. Making the asymmetry distance excessively large would cause the first suction member 12 to remain for a smaller-diameter head on the path of the retaining arm of the second head 9 or even hit the support rollers. Moreover, a greater mutual displacement s of the suction members increases the external dimensions of the clamp, which complicates the movement of the clamp by the robot 2. A constraint of another kind is caused by the fact that the head cannot be dropped from too high, because this would damage the head, or allow the head to drop into an incorrect position such as off the support rollers or to an inclined position against the roll end, whereby the head is crimped when the retaining arm is pressed against it. Thus, the asymmetry displacement of the suction members and the dropping height of the heads must be optimized for the range of head sizes to be placed in a manner that minimizes the suction member asymmetry displacement and the head dropping height.

Besides those described above, the present invention can have alternative embodiments. The construction of the head-grasping members in the clamp can be freely varied, while the clamp structure described above using multiple resilient suction cups for grasping the head has exhibited a malfunction-free and reliable operation in prior-art applications. If the movement of the clamp is implemented with a multi-axis robot, the asymmetry of the clamp, that is, the mutual displacement of the suction members need not be along the longitudinal axis of the arm 14 supporting the clamp, but rather, aligned perpendicular or inclined relative to the longitudinal axis of the arm, since the movement of the clamp can be implemented in a desired manner by the robot 2. Instead of an arm 14, the supporting body for the clamp can be designed in an alternative fashion as, e.g., a tubular frame or shell structure. The clamp according to the present invention can also be used in gantry heading equipment in which the heads are placed using a single manipulator only. In this case, the heads to be fetched are advantageously placed vertically resting on their edges, or slightly inclined from the vertical plane.

Obviously, the clamp must be provided with sensors suited for the application.

Thus, while there have been shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

I claim:

1. A clamp for releasibly grasping paper roll heads during a transfer of the heads from a stack of heads to ends of a paper roll, said clamp comprising:

a body structure; and first and second grasping means asymmetrically fixed to said body structure and capable of releasibly grasping a first and second of the heads on diametrically opposite sides of said body structure in predetermined asymmetrical positions such that center axes of the first and second heads are spaced relative to one another.

2. The clamp of claim 1, wherein the body structure comprises an elongated arm having a longitudinal axis, the longitudinal axis being perpendicular to the center axes of the first and second heads when grasped by said first and second grasping means, respectively.

3. The clamp of claim 1, wherein said first and second grasping means each have center points and wherein the center axes of the first and second heads when grasped by said first and second grasping means, respectively, are aligned with the center points of said first and second grasping means, respectively.

4. The clamp of claim 1, wherein said first and second grasping means are so configured that are capable of grasping heads of identical configurations.

* * * * *